US010069202B1

(12) United States Patent
Gorcea

(10) Patent No.: US 10,069,202 B1
(45) Date of Patent: Sep. 4, 2018

(54) WIDE BAND PATCH ANTENNA

(71) Applicant: Flextronics AP, LLC, Broomfield, CO (US)

(72) Inventor: Dan Gorcea, Ontario (CA)

(73) Assignee: Flextronics AP, LLC, Broomfield, CO (US)

( * ) Notice: Subject to any disclaimer, the term of this patent is extended or adjusted under 35 U.S.C. 154(b) by 12 days.

(21) Appl. No.: 15/078,892

(22) Filed: Mar. 23, 2016

(51) Int. Cl.
*H01Q 1/38* (2006.01)
*H01Q 9/04* (2006.01)

(52) U.S. Cl.
CPC ..... *H01Q 9/0407* (2013.01)

(58) Field of Classification Search
CPC ..... H01Q 9/0407
USPC ..... 343/700 MS
See application file for complete search history.

(56) References Cited

U.S. PATENT DOCUMENTS

| | | | |
|---|---|---|---|
| 4,210,404 | A | 7/1980 | Hanger |
| 5,151,233 | A | 9/1992 | Wendt |
| 5,764,190 | A | 6/1998 | Murch et al. |
| 6,140,966 | A | 10/2000 | Pankinaho |
| 6,624,432 | B1 | 9/2003 | Gabower et al. |
| 6,680,705 | B2 | 1/2004 | Tan et al. |
| 6,693,594 | B2 | 2/2004 | Pankinaho et al. |
| 6,816,076 | B2 | 11/2004 | Pomes |
| 7,026,996 | B2 | 4/2006 | Harano |
| 7,026,999 | B2 | 4/2006 | Umehara et al. |
| 7,119,743 | B2 | 10/2006 | Iguchi et al. |
| 7,136,019 | B2 | 11/2006 | Mikkola et al. |
| 7,319,432 | B2 | 1/2008 | Andersson |
| 7,375,689 | B2 | 5/2008 | Chen et al. |
| 7,385,561 | B2 | 6/2008 | Krupa |
| 7,564,411 | B2 | 7/2009 | Piisila |
| 7,639,192 | B2 | 12/2009 | Tsai et al. |
| 7,869,830 | B2 | 1/2011 | Hartenstein |
| 8,164,526 | B1 | 4/2012 | Aula et al. |
| 8,313,684 | B1 | 11/2012 | Norberg et al. |
| 2002/0102946 | A1 | 8/2002 | SanGiovanni |
| 2005/0007283 | A1 | 1/2005 | Jo et al. |
| 2005/0195124 | A1 | 9/2005 | Puente Baliarda et al. |
| 2007/0139280 | A1 | 6/2007 | Vance |
| 2007/0279286 | A1* | 12/2007 | Coutts ..... H01Q 9/0407 343/700 MS |
| 2009/0229108 | A1 | 9/2009 | Shamblin et al. |

* cited by examiner

*Primary Examiner* — Graham Smith
(74) *Attorney, Agent, or Firm* — Haverstock & Owens LLP

(57) ABSTRACT

A large bandwidth pcb patch antenna comprises an initial antenna patch comprising a main resonator, a first secondary resonator, a second secondary resonator, resonator, and wherein the first secondary resonator and the second secondary resonator are coupled together. By adding two non-connected patches on either sides of a rectangular patch antenna, a significantly larger antenna bandwidth is achieved and without loss of other characteristics.

22 Claims, 15 Drawing Sheets

| Name | Freq | Ang | Mag | RX |
|---|---|---|---|---|
| m1 | 2.4000 | 91.9852 | 0.5281 | 0.5482 + 0.8024i |
| m2 | 2.4500 | -94.4189 | 0.1033 | 0.9637 - 0.2007i |
| m3 | 2.5000 | -151.3096 | 0.6094 | 0.2576 - 0.2398i |

| Name | Freq | Ang | Mag | RX |
|---|---|---|---|---|
| m1 | 2.4000 | 57.0291 | 0.2474 | 1.1854 + 0.5241i |
| m2 | 2.4500 | -162.1850 | 0.2102 | 0.6617 - 0.0890i |
| m3 | 2.5000 | -66.7847 | 0.2291 | 1.0868 - 0.4831i |

| Name | Freq | Ang | Mag | RX |
|---|---|---|---|---|
| m1 | 2.4000 | 81.4366 | 0.1750 | 0.9907 + 0.3537i |
| m2 | 2.4500 | 102.8386 | 0.1658 | 0.8832 - 0.2936i |
| m3 | 2.5000 | -110.7773 | 0.1233 | 0.8931 - 0.2091i |

WIDE BAND PATCH ANTENNA

FIELD OF THE INVENTION

This invention generally relates to patch antenna designs. More particularly, this invention relates to a method and devices for obtaining a large bandwidth pcb patch antenna.

BACKGROUND OF THE INVENTION

Classic patch antenna designs typically comprise a narrow frequency band. The antennas are basically high Q resonators. This creates problems in designing and manufacturing antennas for example, in WiFi networks. One problem is cost as expensive dielectric materials need to be used in order to mitigate the narrow antenna bandwidth. This cost impact is two fold 1) very stable dielectrics are needed in order to prevent antenna characteristic variations due to temperature, aging, and other factors, and 2) thick dielectrics must be used, as the dielectric thickness can facilitate larger bandwidths.

SUMMARY OF THE INVENTION

A method of manufacturing a large bandwidth pcb patch antenna comprises constructing an initial antenna patch comprising a main resonator, adding a first secondary resonator, adding a second secondary resonator, and coupling the first secondary resonator and the second secondary resonator. By adding two non-connected patches on either sides of a rectangular patch antenna, a significantly larger antenna bandwidth is achieved and without loss of other characteristics.

In one aspect, a method of manufacturing a large bandwidth pcb patch antenna comprises constructing an initial antenna patch comprising a main resonator, adding a first secondary resonator, adding a second secondary resonator, and coupling the first secondary resonator and the second secondary resonator. In some embodiments, the first secondary resonator and the second secondary resonator comprise a first frequency. Particularly, adjusting a coupling factor of the first secondary resonator and the second secondary resonator achieves a wider bandwidth for return loss. Consequently, the return loss S11 is better than a threshold for an increased bandwidth. In some embodiments, the first secondary resonator and the second secondary resonator are on symmetrically opposite sides of the main resonator. The antenna is able to create a radiation lobe similar to that of a single patch antenna. In some embodiments, the method comprises adding a third secondary resonator and a fourth secondary resonator. The third secondary resonator and the fourth secondary resonator comprise a second frequency. In some embodiments, the third secondary resonator and the fourth secondary resonator are on symmetrically opposite sides of the main resonator.

In another aspect, a pcb patch antenna comprises an antenna patch comprising a main resonator, a first secondary resonator, and a second secondary resonator, coupled to the first secondary resonator. In some embodiments, the first secondary resonator and the second secondary resonator comprise a first frequency. Particularly, adjusting a coupling factor of the first secondary resonator and the second secondary resonator achieves a wider bandwidth for return loss. Consequently, the return loss S11 is better than a threshold for an increased bandwidth. In some embodiments, the first secondary resonator and the second secondary resonator are on symmetrically opposite sides of the main resonator. The antenna is able to create a radiation lobe similar to that of a single patch antenna. In some embodiments, the method comprises adding a third secondary resonator and a fourth secondary resonator. The third secondary resonator and the fourth secondary resonator comprise a second frequency. In some embodiments, the third secondary resonator and the fourth secondary resonator are on symmetrically opposite sides of the main resonator.

In a further aspect, a pcb patch antenna comprises an antenna patch comprising a main resonator, a first plurality of secondary resonators and a second plurality of secondary resonators, wherein the first plurality of secondary resonators and the second plurality of secondary resonators comprise separate frequencies. In some embodiments, the first plurality of secondary resonators are along an X direction and the second plurality of secondary resonators are along a Y direction. In some embodiments, the first plurality of secondary resonators are on symmetrically opposite sides of the main resonator and the second plurality of secondary resonators are on symmetrically opposite sides of the main resonator.

DETAILED DESCRIPTION OF THE INVENTION

Embodiments of the invention are directed to a wide band patch antenna. The large bandwidth pcb patch antenna comprises an initial antenna patch comprising a main resonator, adding a first secondary resonator, adding a second secondary resonator, and coupling the first secondary resonator and the second secondary resonator. By adding two non-connected patches on either sides of a rectangular patch antenna, a significantly larger antenna bandwidth is achieved and without loss of other characteristics.

Reference will now be made in detail to implementations of the wide band patch antenna as illustrated in the accompanying drawings. The same reference indicators will be used throughout the drawings and the following detailed description to refer to the same or like parts. In the interest of clarity, not all of the routine features of the implementations described herein are shown and described. It will be appreciated that in the development of any such actual implementation, numerous implementation-specific decisions can be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
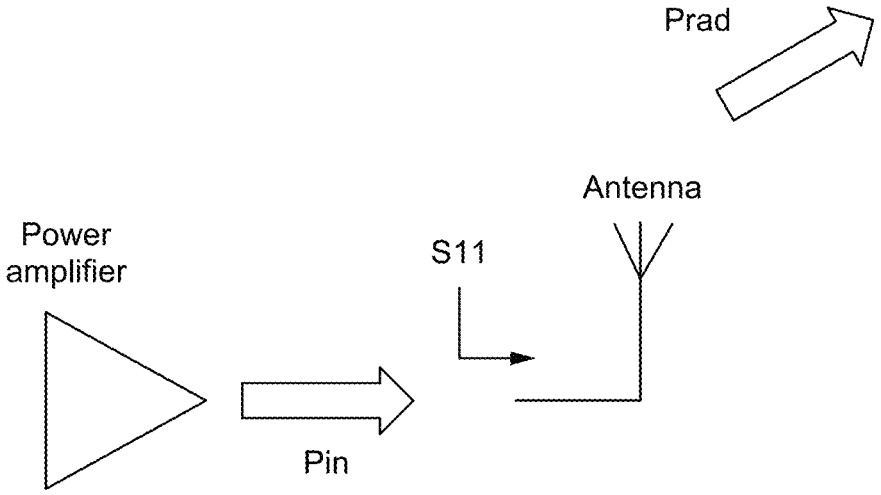
FIG. 1 illustrates a function of an antenna in accordance with some embodiments.

A patch antenna, such as a WiFi patch antenna must have a high radiating efficiency, a frequency bandwidth, and spatial directivity. Generally as shown in FIG. 1, the radiating efficiency is the ratio (in percentage) of the total radiated power Prad and power fed to an antenna port from a power amplifier Pin. An important part of an efficient antenna is a good reflection coefficient (matching) at the antenna port. This means achieving a good S11, or return loss at the antenna port.

Figure 2:
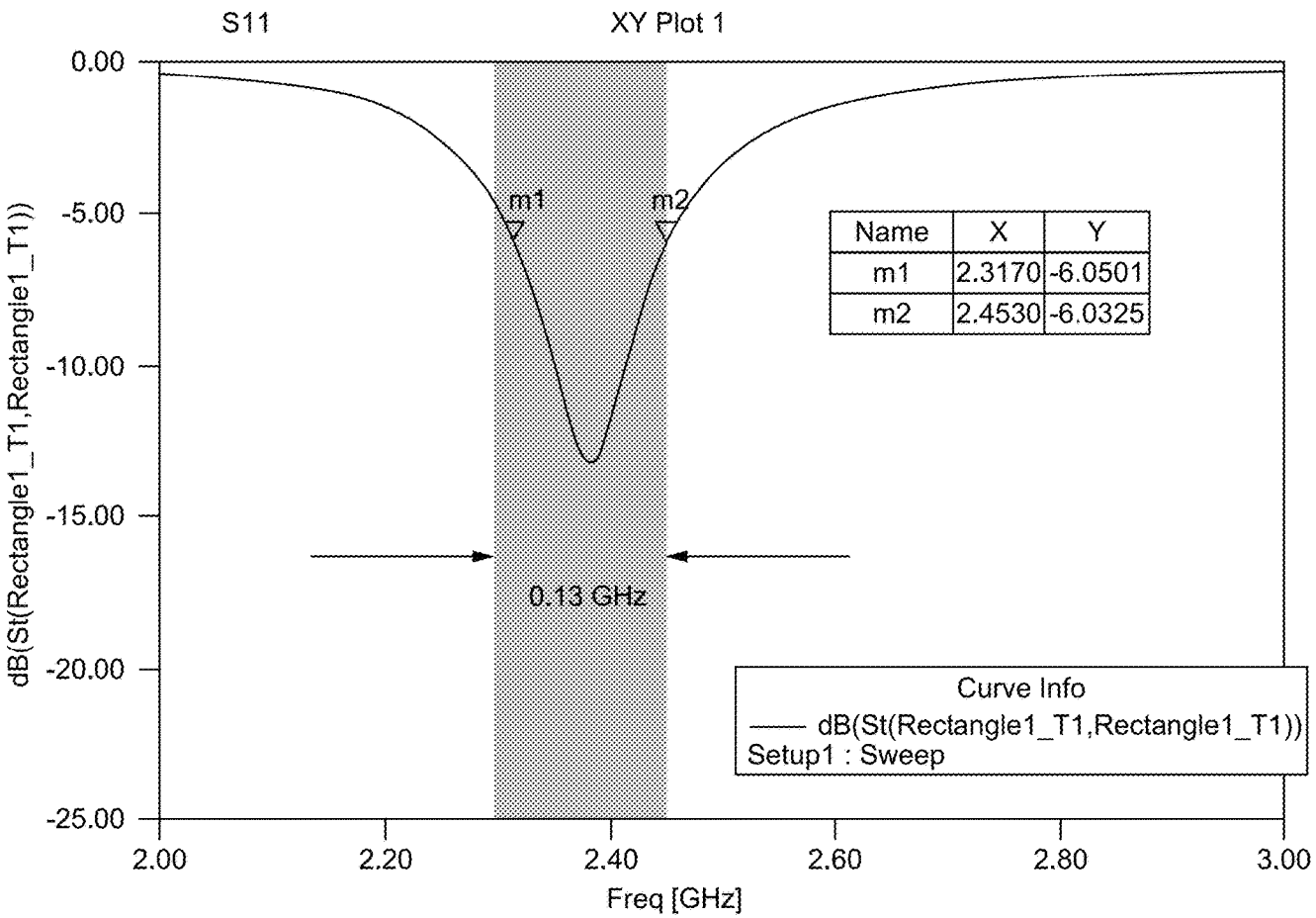
FIG. 2 illustrates a XY plot showing the S11 return loss at the antenna port across a range of different frequencies in accordance with some embodiments.

FIG. 2 illustrates a XY plot showing the S11 return loss at the antenna port across a range of different frequencies. The antenna bandwidth comprises the frequency range over which the antenna has an acceptable radiation efficiency. This closely relates to the range of frequencies having a good S11 return loss at the antenna port. For WiFi, channels begin at 2.4 GHz and end at 2.49 GHz so a bandwidth of at least 0.1 GHz is required. As shown within FIG. 2, setting the S11 threshold at −6 dB achieves good return losses between 2.32 GHz and 2.45 GHz. The antenna bandwidth is close to 0.13 GHz.

Figure 3B:
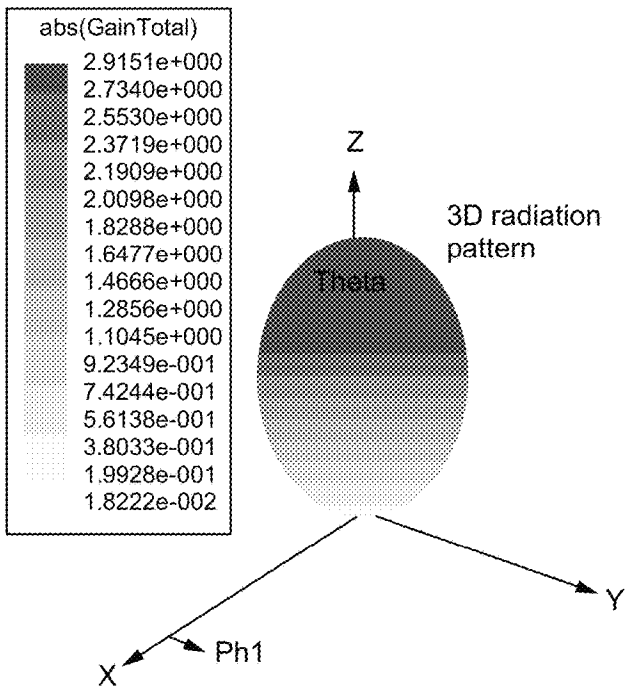
FIG. 3B illustrates a 3d radiation pattern for a patch antenna in accordance with some embodiments.
Figure 3A:
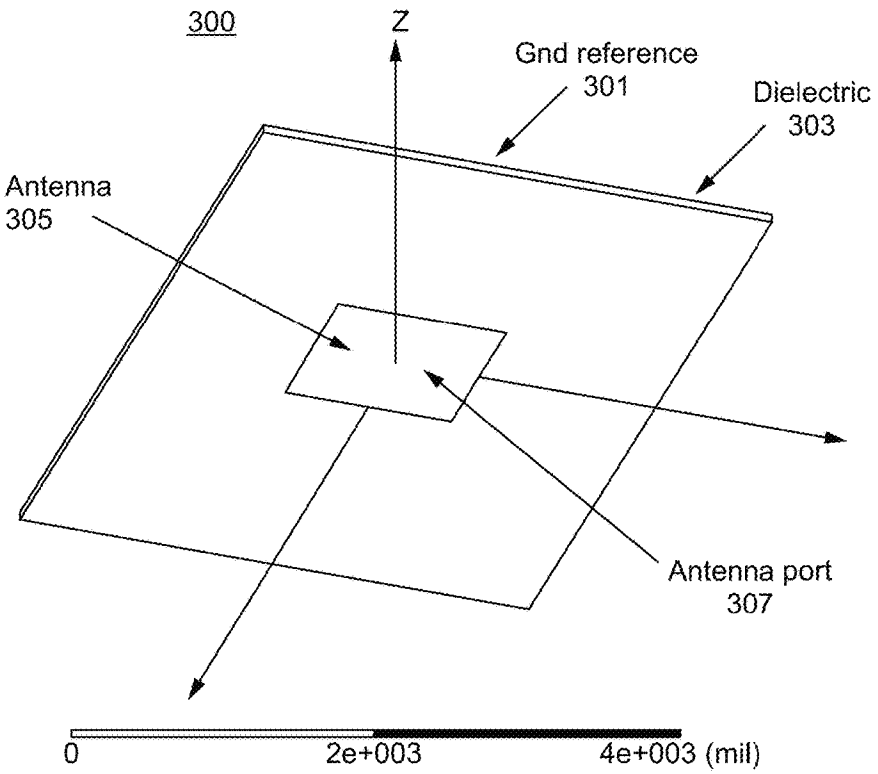
FIG. 3A illustrates a patch antenna in accordance with some embodiments.

FIG. 3A illustrates a patch antenna. The antenna 300 comprises a ground reference 301 or ground plane, a dielectric substrate 303, an antenna 305, and an antenna port 307. The patch antenna 300 is a particular class of antennas that are easy to manufacture and easy to aggregate into large antenna arrays. This patch antenna design is optimized for its best antenna parameters and has good directivity and efficiency. However, the issue becomes over what frequency range is the antenna able to maintain the good efficiency. Additionally, the patch antenna 300 is a high Q resonant structure so that is very hard to achieve large bandwidths.

FIG. 3B illustrates an exemplary 3d radiation pattern for the patch antenna 300.

Figure 4:
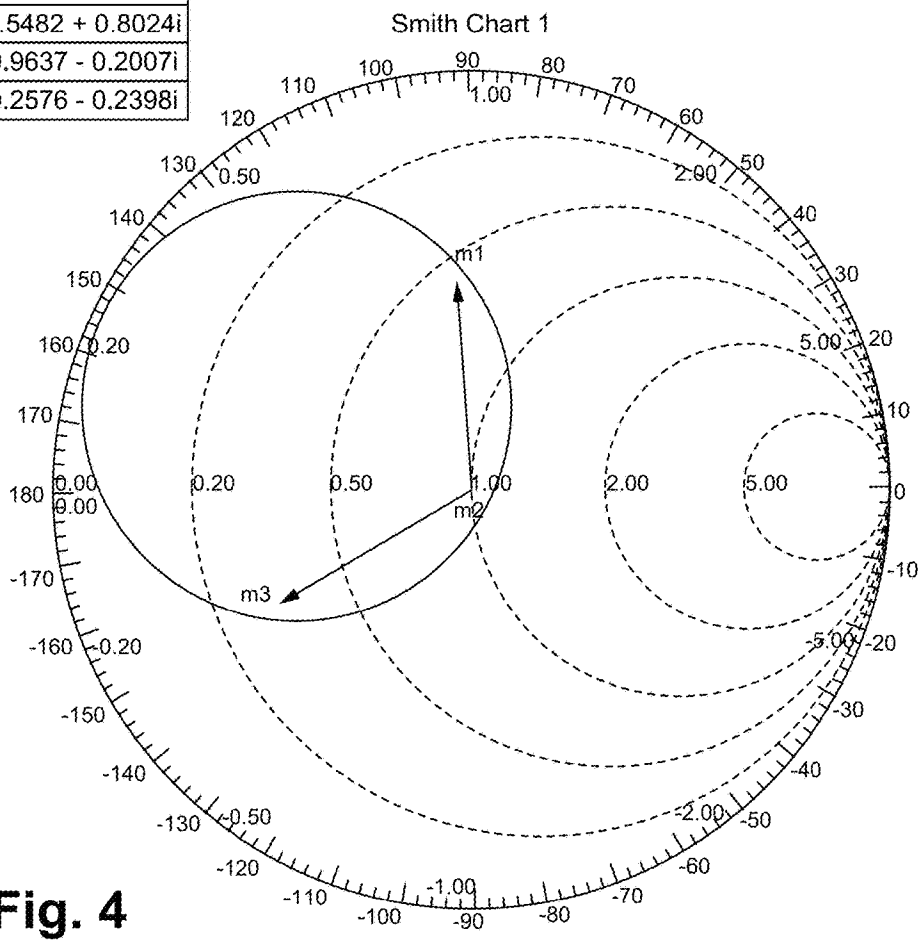
FIG. 4 illustrates a Smith Chart of the antenna port impedance as a function of frequency in accordance with some embodiments.

FIG. 4 illustrates a Smith Chart of the antenna 300 port impedance as a function of frequency. As shown within FIG. 4, there are there are two markers for the ends of the WiFi spectrum and one for the center of the frequency. The marker m1 comprises 2.4 GHz, the marker m2 comprises 2.45 GHz, and the marker m3 comprises 2.5 GHz. To have a good S11, all the markers should be close to the center of the Smith Chart. While the marker m2 is near the center, markers m1 and m3 are relatively far away and cannot be brought close to the center without pushing the other markers away from the center.

Figure 5:
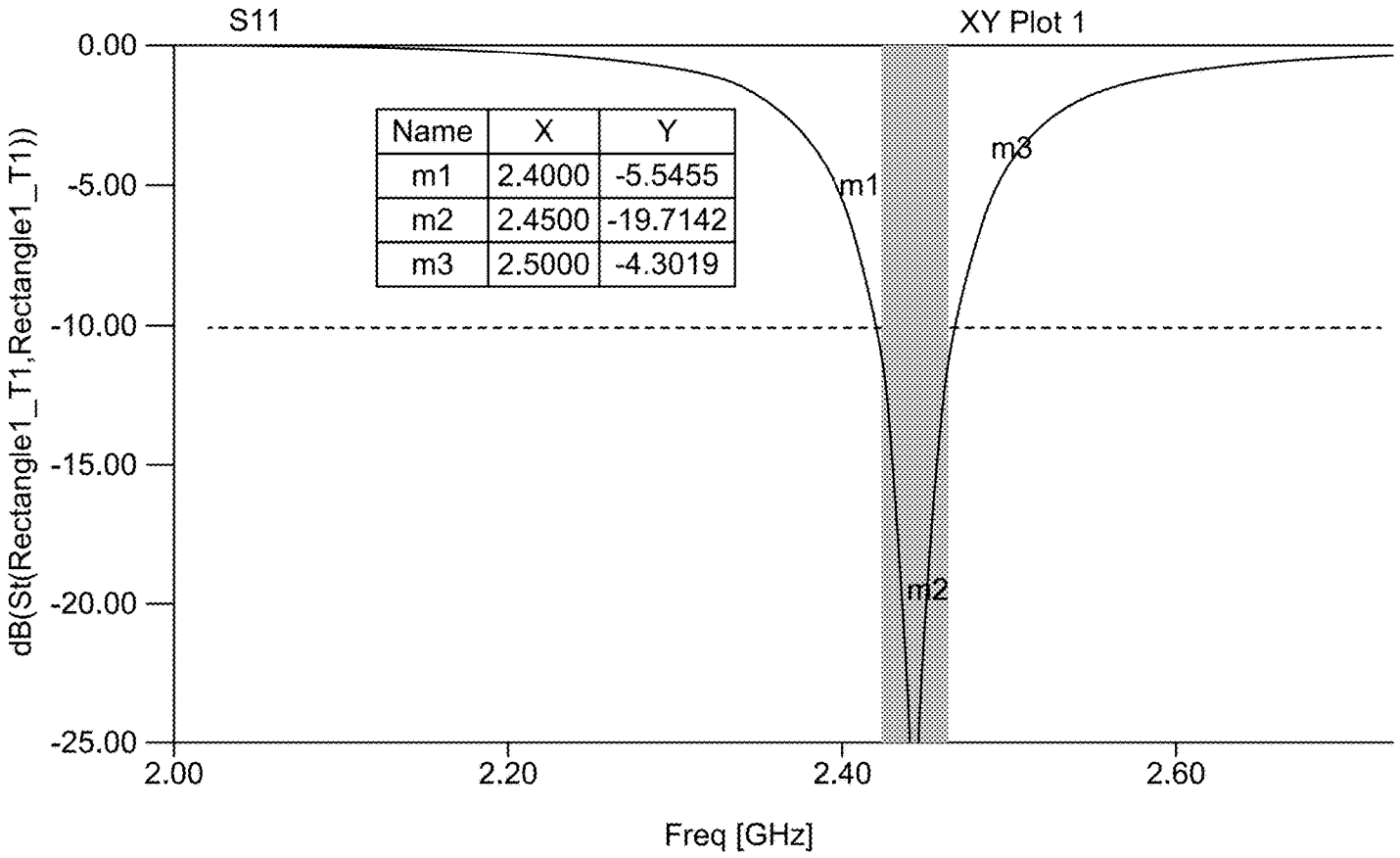
FIG. 5 illustrates an XY plot showing a bandwidth of a patch antenna in accordance with some embodiments.

As shown within FIG. 5, the XY plot indicates that only the S11 return loss at the marker m2 passes the threshold. Markers m1 and m3 are well above the threshold line. The antenna bandwidth is only 0.02 GHz, which is far short of the WiFi threshold requirement of 0.1 GHz.

Figure 6A:
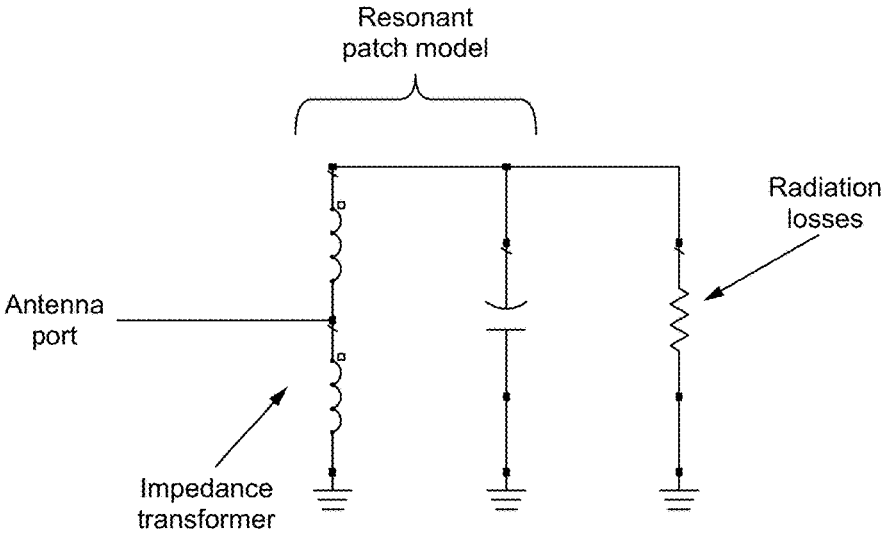
FIG. 6A illustrates a the modeling of a real patch antenna comprising discrete elements in accordance with some embodiments.
Figure 6B:
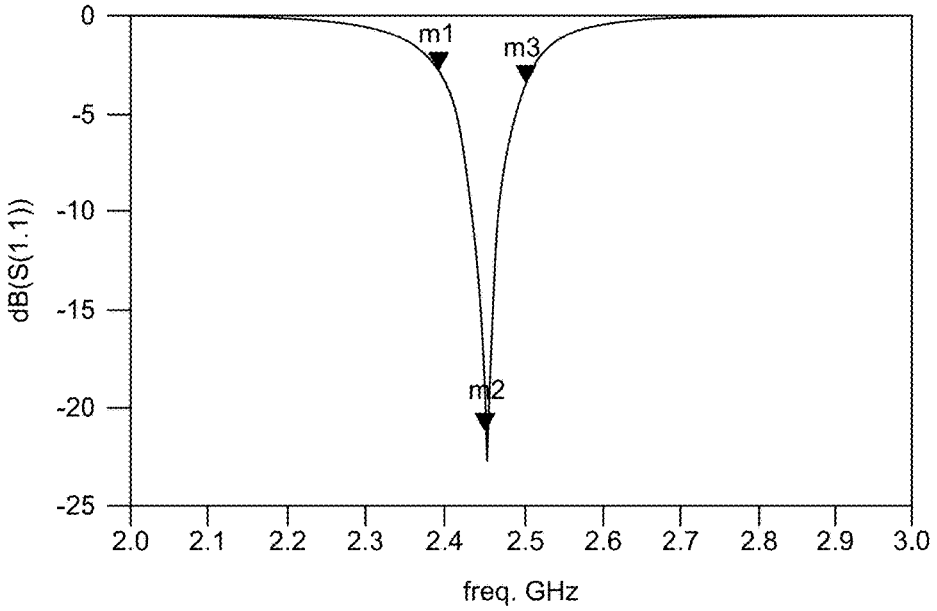
FIG. 6B illustrates an XY plot of the return loss S11 of the model in accordance with some embodiments.

As shown within FIGS. 6A and 6B, a discrete model of an antenna can be tuned to match a patch antenna simulation and show the same narrow bandwidth. In order to increase antenna bandwidth, one or more coupled resonant structures can be used. By adding a second resonator coupled with a first resonator, the bandwidth can be increased.

Figure 7A:
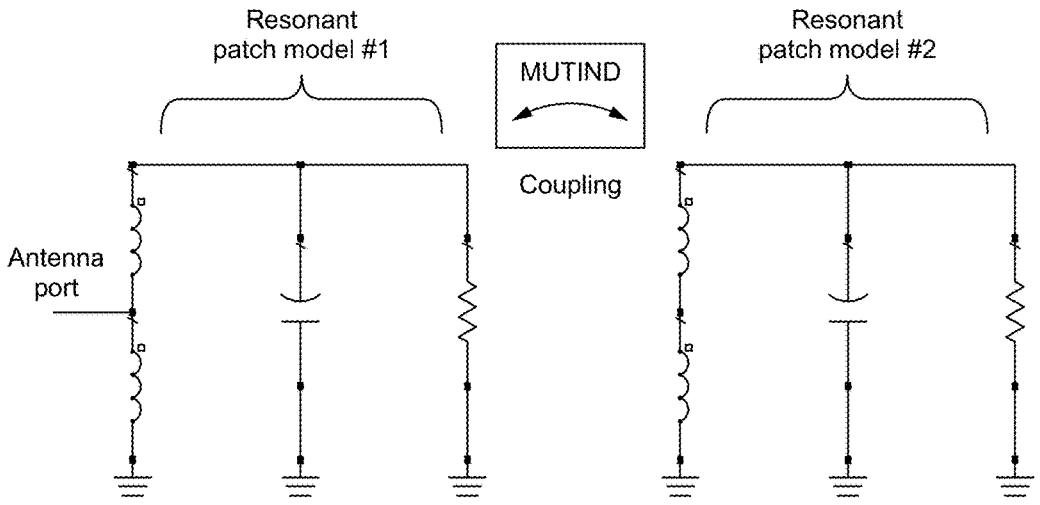
FIG. 7A illustrates a model made with discrete elements of two resonant coupled patches in accordance with some embodiments.
Figure 7B:
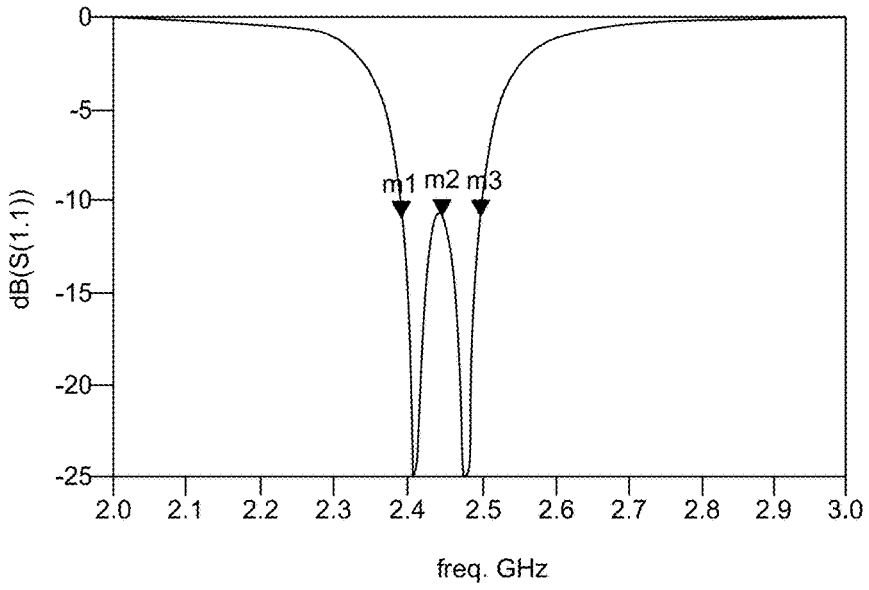
FIG. 7B illustrates an XY plot of the return loss S11 of the model of coupled resonators in accordance with some embodiments.

As shown within FIGS. 7A and 7B, by adjusting a coupling factor and the resonant frequency of a first and second resonator, it is possible to achieve a greater bandwidth for the return loss. The new return loss S11 is better than the threshold for an increased bandwidth of 0.1 GHz and a good S11 for the large bandwidth is achieved.

Figure 8:
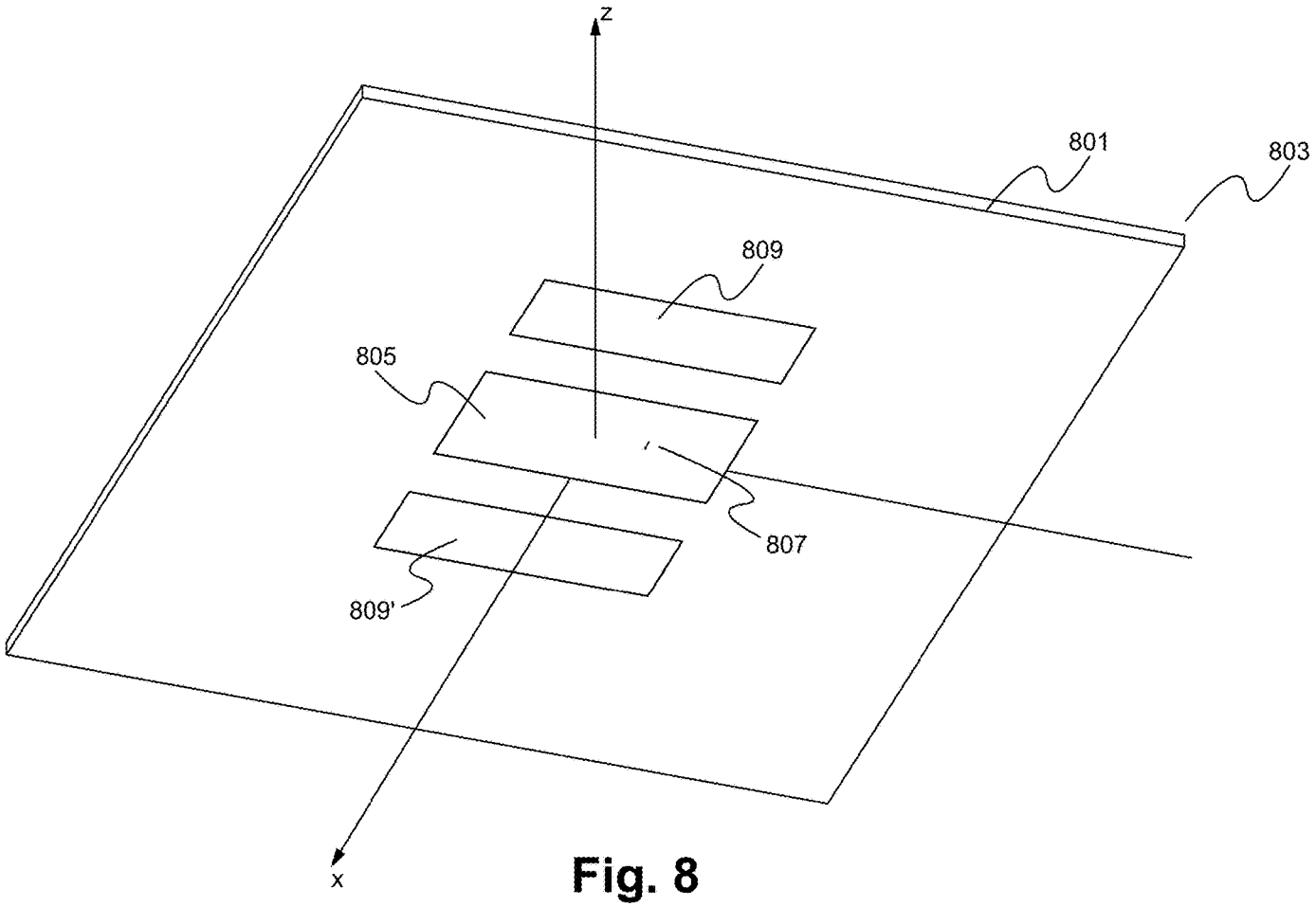
FIG. 8 illustrates a patch antenna in accordance with some embodiments.

FIG. 8 illustrates a patch antenna comprising one or more secondary resonators. The pcb patch antenna 800 comprises a ground reference 801 or ground plane, a dielectric substrate 803, an antenna main resonator 805, and an antenna port 307. As shown within FIG. 8, the antenna 800 also comprises a first secondary resonator 809 and a second secondary resonator 809'. In some embodiments, the first secondary resonator and the second secondary resonator comprise a first frequency. As described above, adjusting a coupling factor of the first secondary 809 resonator and the second secondary 809' resonator achieves a wider bandwidth for return loss. The return loss S11 is better than a threshold for an increased bandwidth of 0.1 Ghz.

Figure 9:
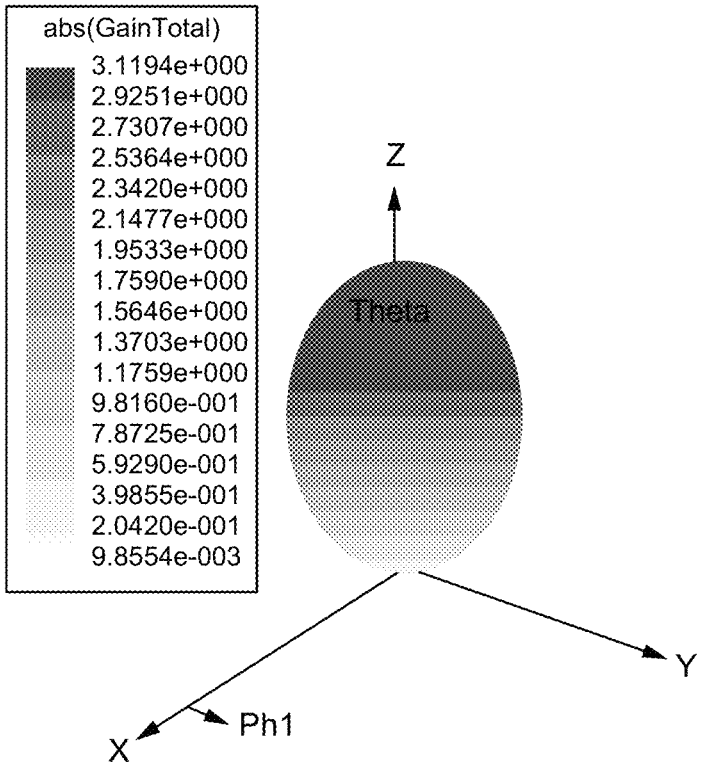
FIG. 9 illustrates a 3d radiation pattern for a patch antenna in accordance with some embodiments.

The first secondary resonator 809 and the second secondary resonator 809' show a slight phase shift tilting the main radiation lobe toward the secondary resonator. Accordingly, as shown within FIG. 8, the first secondary resonator 809 and the second secondary resonator 809' are placed on symmetrically opposite sides of the main resonator 805. Consequently, as shown within FIG. 9, the resulting radiation lobe is back symmetric and normal to the plane of the patch antenna 800. This creates a radiation lobe similar to that of a single patch antenna.

Figure 10:
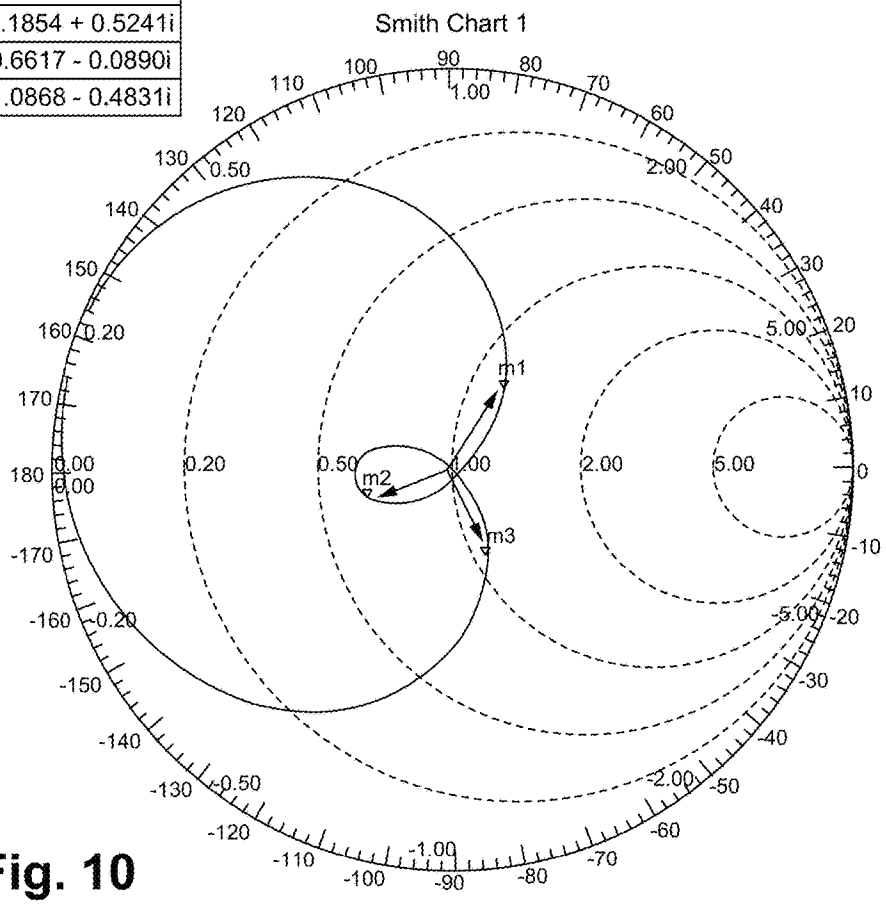
FIG. 10 illustrates a Smith Chart of the antenna port impedance as a function of frequency in accordance with some embodiments.

FIG. 10 illustrates a Smith Chart of the antenna 800 port impedance as a function of frequency. As shown within FIG. 10, by adding the first secondary resonator 809 and the second secondary resonator 809', a fold in the impedance line is created and the markers m1, m2, and m3 are pulled tighter toward the center of the Smith Chart. The markers m1, m2, and m3 are closer to the center than for an antenna comprising a single resonator, such as described above. The return loss for than antenna 800 is better across a significantly larger bandwidth.

Figure 11:
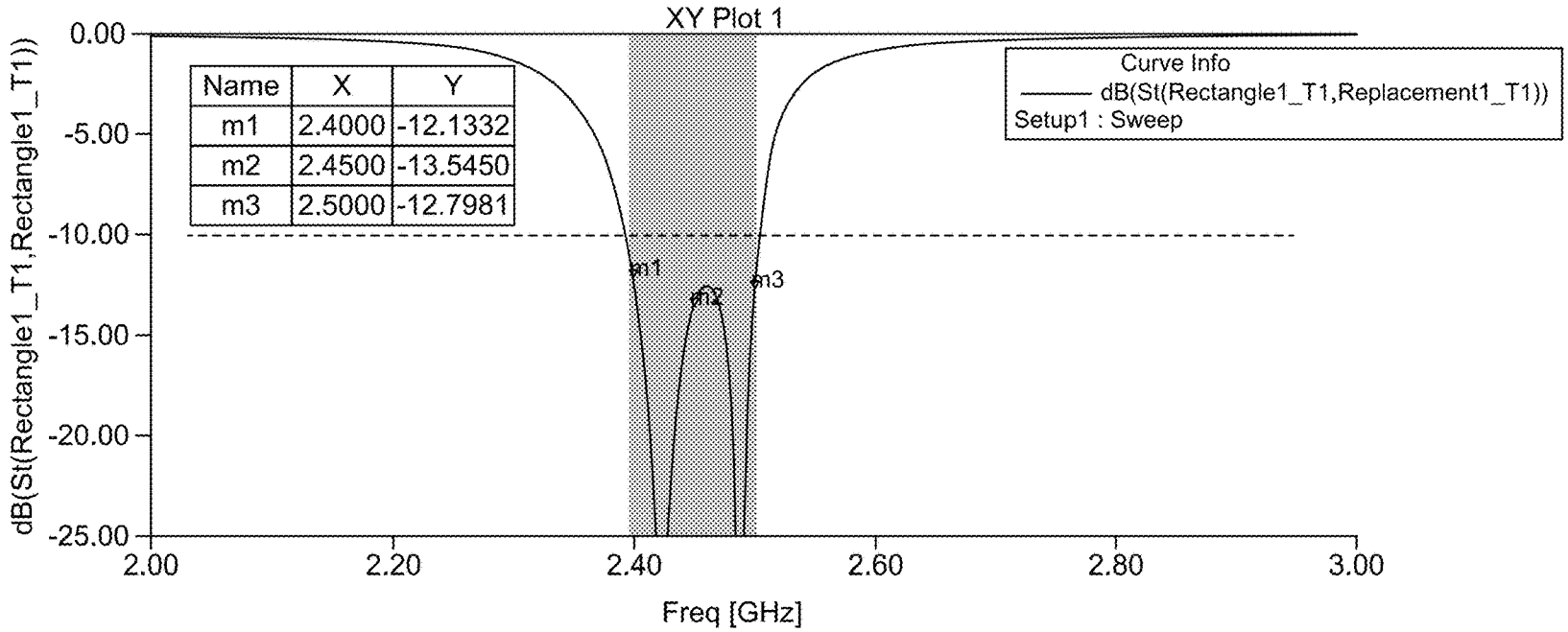
FIG. 11 illustrates an XY plot of the return loss S11 of a coupled patch antenna showing an increased frequency bandwidth in accordance with some embodiments.

As shown within FIG. 11, the XY plot shows that the S11 return loss at the markers m1, m2, and m3 is below the threshold of −10 dB. The S11 is better than −12 dB over an increased bandwidth of 0.1 GHz.

Figure 12:
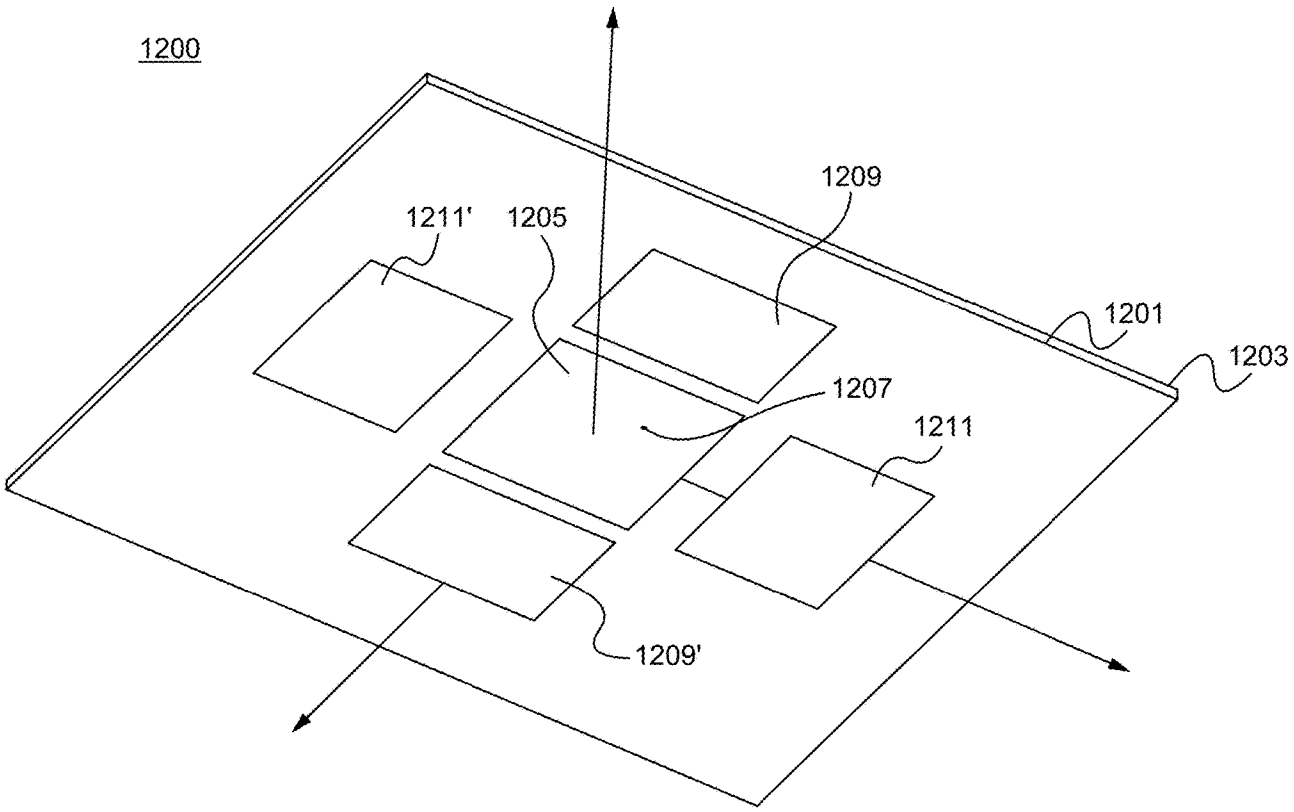
FIG. 12 illustrates a patch antenna in accordance with some embodiments.

FIG. 12 illustrates a patch antenna comprising one or more secondary resonators in accordance with some embodiments. The pcb patch antenna 1200 comprises a ground reference 1201 or ground plane, a dielectric substrate 803, an antenna main resonator 1205, and an antenna port 1207. As shown within FIG. 12, the antenna 1200 also comprises a first secondary resonator 1209 and a second secondary resonator 1209'. In some embodiments, the first secondary resonator 1209 and the second secondary resonator 1209' comprise a first frequency.

As further shown within FIG. 12, the antenna 1200 comprises a third secondary resonator 1211 and a fourth secondary resonator 1211'. The first secondary resonator 1209 and the second secondary resonator 1209' run along an X direction and the third secondary resonator 1211 and a fourth secondary resonator 811' run along a Y direction. The third secondary resonator 1211 and a fourth secondary resonator 1211' comprise a comprise a second frequency different from the first frequency. The third secondary resonator 1211 and the fourth secondary 1211' resonator are on symmetrically opposite sides of the main resonator 1205.

Figure 13:
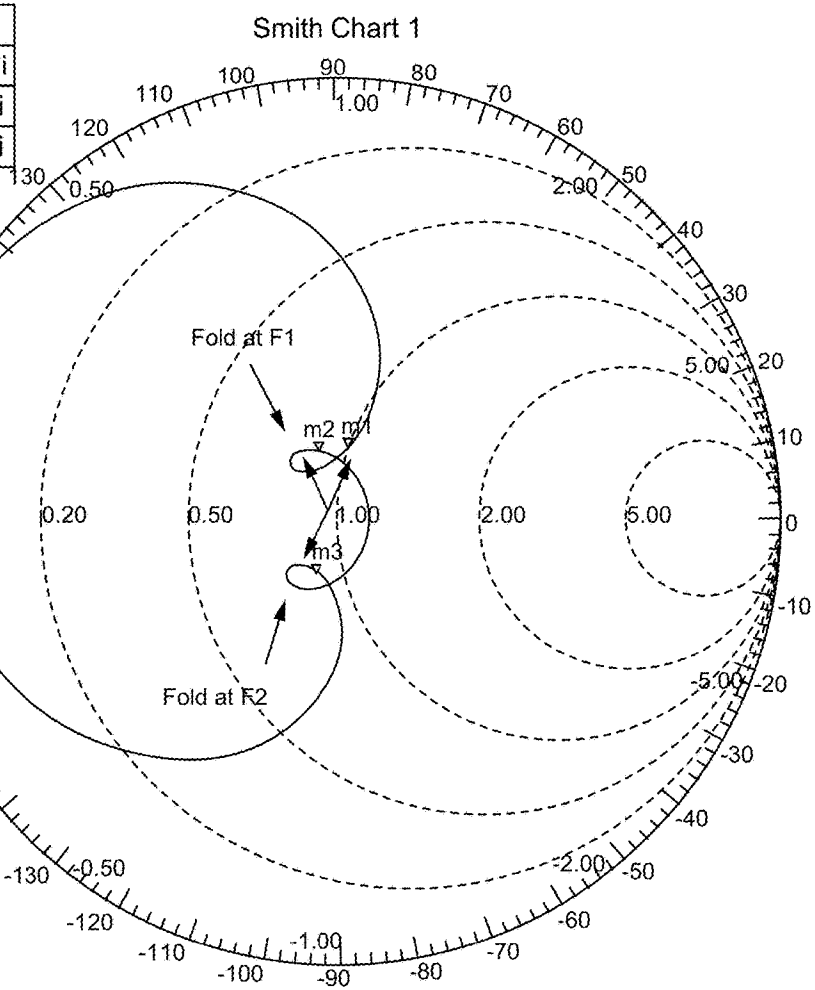
FIG. 13 illustrates a Smith Chart of the antenna port impedance as a function of frequency in accordance with some embodiments.

FIG. 13 illustrates a Smith Chart of the antenna 1200 port impedance as a function of frequency. As shown within FIG. 12, by adding a first plurality of secondary resonators and a second plurality of secondary resonators, two folds in the impedance line are created and the markers m1, m2, and m3 are pulled tighter toward the center of the Smith Chart. The markers m1, m2, and m3 are closer to the center than for the single resonator, such as described above, and the return loss is better across a significantly larger bandwidth.

Figure 14:
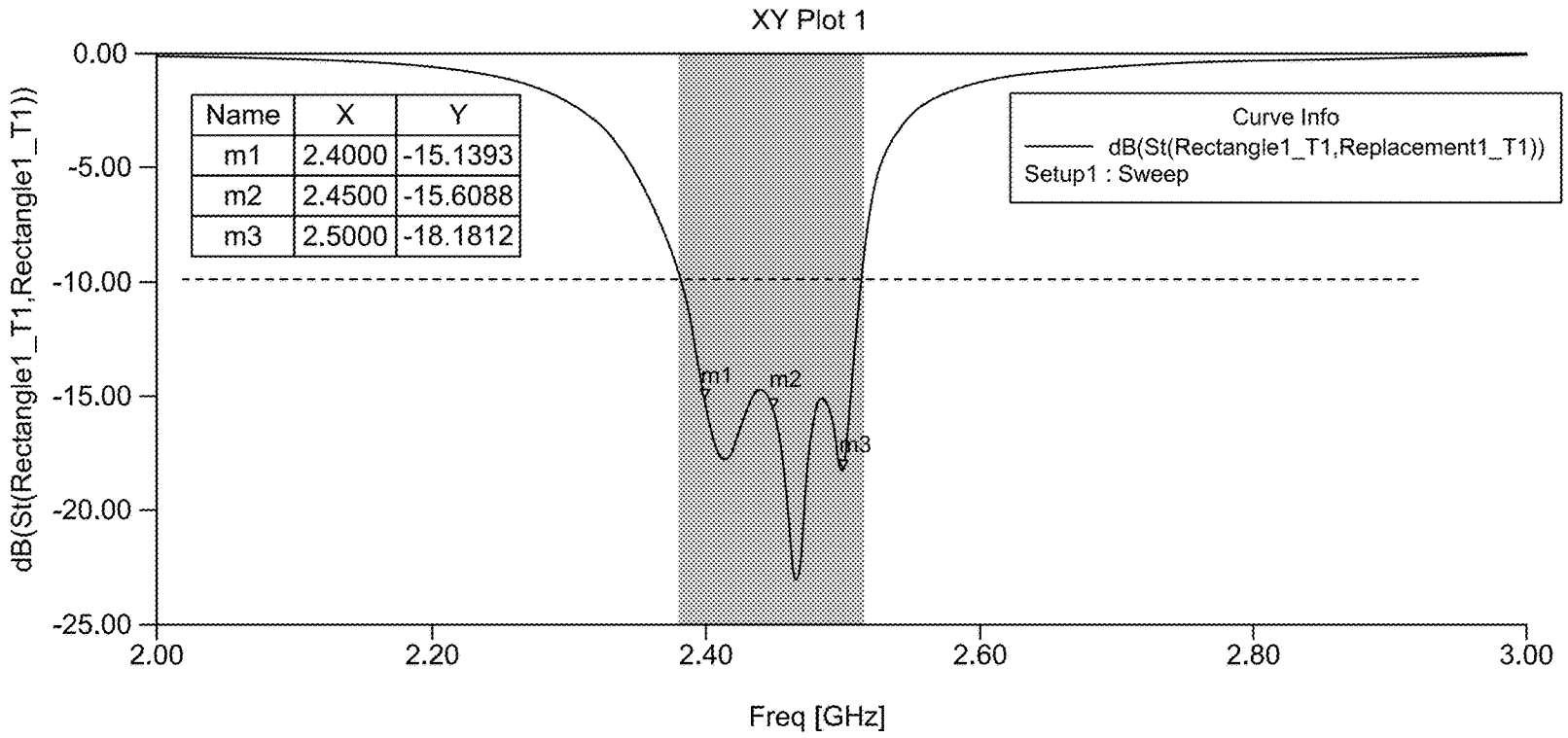
FIG. 14 illustrates an XY plot of the return loss S11 of a coupled patch antenna showing an increased frequency bandwidth in accordance with some embodiments.

As shown within FIG. 14, the XY plot shows that the S11 return loss at the markers m1, m2, and m3 is below the threshold of −10 dB. The S11 is better than −15 dB over an increased bandwidth of 0.12 GHz.

Figure 15:
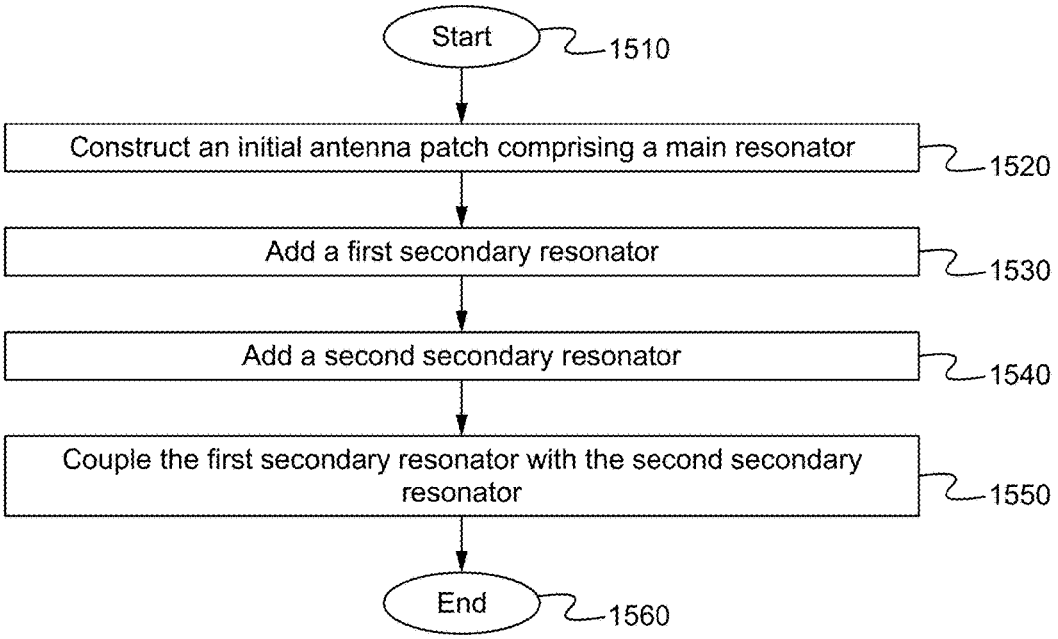
FIG. 15 illustrates a method of manufacturing a large bandwidth pcb patch antenna in accordance with some embodiments.

FIG. 15 illustrates a method of manufacturing a large bandwidth pcb patch antenna. The method begins in the step 1510. In the step 1520, an initial antenna patch comprising a main resonator is constructed. In the step 1530 a first secondary resonator is added and in the step 1540 a second secondary resonator is added. Then in the step 1550, the first secondary resonator and the second secondary resonator are coupled together. In the step 1560, the method ends. In some embodiments, the first secondary resonator and the second secondary resonator comprise a first frequency. The coupling factor of the first secondary resonator and the second secondary resonator is adjusted to achieve a wider bandwidth for return loss. Consequently, the return loss S11 is better than a threshold for an increased bandwidth. In some embodiments, the first secondary resonator and the second secondary resonator are on symmetrically opposite sides of the main resonator. Particularly, the antenna creates a radiation lobe similar to that of a single patch antenna. In some embodiments, the method comprises adding a third secondary resonator and a fourth secondary resonator. The third secondary resonator and the fourth secondary resonator comprise a second frequency. In some embodiments, the third secondary resonator and the fourth secondary resonator are on symmetrically opposite sides of the main resonator.

In operation, a large bandwidth pcb patch antenna is constructed with an initial antenna patch comprising a main resonator, a first secondary resonator, a second secondary resonator, and wherein the first secondary resonator and the second secondary resonator are coupled together. By adding two non-connected patches on either sides of a rectangular patch antenna, a significantly larger antenna bandwidth is achieved and without loss of other characteristics. The additional patches have carefully selected dimensions and clearance to the main resonator in order to achieve a larger bandwidth. Particularly, this allows for thin and cheap dielectrics to be used in an antenna such as a WiFi antenna design. There is no adverse effects to the antenna characteristics and the cost maintains the same because the design remains a pcb layout design. Accordingly, the wide band patch antenna as described herein has many advantages.

The present invention has been described in terms of specific embodiments incorporating details to facilitate the understanding of the principles of construction and operation of the invention. Such references, herein, to specific embodiments and details thereof are not intended to limit the scope of the claims appended hereto. It will be apparent to those skilled in the art that modifications can be made in the embodiments chosen for illustration without departing from the spirit and scope of the invention. Specifically it will be apparent to someone of ordinary skill in the art that the invention is able to be used to fold any appropriate flexible circuit and to insert the circuit within the circuit housing.

I claim:

1. A method of manufacturing a large bandwidth pcb patch antenna comprising:

a. constructing an initial antenna patch comprising a main resonator;

b. adding a first secondary resonator;

c. adding a second secondary resonator; and d. coupling the first secondary resonator and the second secondary resonator, such that the main resonator, the first secondary resonator, and the second secondary resonator cooperate to generate only one radiation lobe, the one radiation lobe similar to that of a single patch antenna, wherein the return loss S11 is better than a threshold of −10 dB for bandwidth of 0.1 Ghz and a frequency of 2.4 GHz to 2.5 GHz.

2. The method of claim 1, wherein the first secondary resonator, the second secondary resonator and the patch antenna comprise a first frequency.

3. The method of claim 1, wherein adjusting a coupling factor of the first secondary resonator and the second secondary resonator achieves a wider bandwidth for return loss.

4. The method of claim 1, wherein the first secondary resonator and the second secondary resonator are on symmetrically opposite sides of the main resonator.

5. The method of claim 1, wherein antenna creates a radiation lobe similar to that of a single patch antenna.

6. The method of claim 1, comprising adding a third secondary resonator and a fourth secondary resonator.

7. The method of claim 6, wherein the third secondary resonator, the fourth secondary resonator and the patch antenna comprise a second frequency.

8. The method of claim 6, wherein the third secondary resonator and the fourth secondary resonator are on symmetrically opposite sides of the main resonator.

9. The method of claim 1, wherein the pcb patch antenna comprises a WiFi antenna.

10. A pcb patch antenna comprising:

a. an antenna patch comprising a main resonator;

b. a first secondary resonator; and c. a second secondary resonator, coupled to the first secondary resonator;

such that the main resonator, the first secondary resonator, and the second secondary resonator cooperate to generate only one radiation lobe, the one radiation lobe similar to that of a single patch antenna, wherein the return loss S11 is better than a threshold of −10 dB for bandwidth of 0.1 GHz and a frequency of 2.4 GHz to 2.5 GHz.

11. The pcb patch antenna of claim 10, wherein the first secondary resonator and the second secondary resonator comprise a first frequency.

12. The pcb patch antenna of claim 10, wherein adjusting a coupling factor of the first secondary resonator and the second secondary resonator achieves a wider bandwidth for return loss.

13. The pcb patch antenna of claim 10, wherein the first secondary resonator and the second secondary resonator are on symmetrically opposite sides of the main resonator.

14. The pcb patch antenna of claim 10, wherein the antenna creates a radiation lobe similar to that of a single patch antenna.

15. The pcb patch antenna of claim 10, comprising adding a third secondary resonator and a fourth secondary resonator.

16. The pcb patch antenna of claim 15, wherein the third secondary resonator and the fourth secondary resonator comprise a second frequency.

17. The pcb patch antenna of claim 15, wherein the third secondary resonator and the fourth secondary resonator are on symmetrically opposite sides of the main resonator.

18. The pcb patch antenna of claim 10, wherein the pcb patch antenna comprises a WiFi antenna.

19. A pcb patch antenna comprising:

a. an antenna patch comprising a main resonator;

b. a first plurality of secondary resonators; and c. a second plurality of secondary resonators, wherein the first plurality of secondary resonators and the second plurality of secondary resonators comprise separate frequencies, and the main resonator, the first plurality of secondary resonators, and the second plurality of secondary resonators cooperate to generate only one radiation lobe, the one radiation lobe similar to that of a single patch antenna, wherein the return loss S11 is better than a threshold of −10 dB for bandwidth of 0.1 GHz and a frequency of 2.4 GHz to 2.5 GHz.

20. The pcb patch antenna of claim 19, wherein the first plurality of secondary resonators are along an X direction and the second plurality of secondary resonators are along a Y direction.

21. The pcb patch antenna of claim 19, wherein the first plurality of secondary resonators are on symmetrically opposite sides of the main resonator and the second plurality of secondary resonators are on symmetrically opposite sides of the main resonator.

22. The pcb patch antenna of claim 19, wherein the pcb patch antenna comprises a WiFi antenna.

* * * * *